US006668425B2

(12) United States Patent
Breuer et al.

(10) Patent No.: US 6,668,425 B2
(45) Date of Patent: Dec. 30, 2003

(54) DEVICE ON A CARDING MACHINE FOR CLEANING AND OPENING FIBER MATERIAL

(75) Inventors: Achim Breuer, Aachen (DE); Rolf Kamphausen, Monchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/237,107

(22) Filed: Sep. 9, 2002

(65) Prior Publication Data

US 2003/0046796 A1 Mar. 13, 2003

(30) Foreign Application Priority Data

Sep. 8, 2001 (DE) ..... 101 44 211

(51) Int. Cl.[7] ..... D01G 15/00
(52) U.S. Cl. ..... 19/98; 19/109; 19/200
(58) Field of Search ..... 19/65 A, 98, 104, 19/105, 107, 108, 109, 110, 113, 205

(56) References Cited

U.S. PATENT DOCUMENTS

| | | | | | |
|---|---|---|---|---|---|
| 4,982,478 | A | * | 1/1991 | Stahli et al. | 19/102 |
| 5,031,279 | A | * | 7/1991 | Temburg | 19/104 |
| 5,075,930 | A | * | 12/1991 | Carey et al. | 19/104 |
| 5,241,726 | A | * | 9/1993 | Pezzoli et al. | 19/200 |
| 5,448,800 | A | | 9/1995 | Faas et al. | |
| 5,530,994 | A | * | 7/1996 | Loeffler | 19/109 |
| 6,145,166 | A | | 11/2000 | Waeber et al. | |
| 6,477,734 | B1 | | 11/2002 | Gresser et al. | |
| 6,477,742 | B2 | * | 11/2002 | Pferdmenges et al. | 19/109 |

FOREIGN PATENT DOCUMENTS

| | | |
|---|---|---|
| DE | 39 02 202 A1 | 8/1990 |
| DE | 39 02 204 A1 | 8/1990 |
| DE | 39 08 834 A1 | 9/1990 |
| EP | 0 388 791 A1 | 9/1990 |
| EP | 0 848 091 A1 | 6/1998 |
| EP | 1 101 844 A1 | 5/2001 |
| GB | 2 083 848 A | 3/1982 |
| GB | 2 205 590 A | 12/1988 |
| GB | 2 228 495 A | 8/1990 |
| GB | 2 368 072 A | 4/2002 |
| NL | 8003654 | 1/1982 |
| WO | WO 90/11392 A1 | 10/1990 |
| WO | WO 99/61688 A1 | 12/1999 |

* cited by examiner

*Primary Examiner*—Gary L. Welch
(74) *Attorney, Agent, or Firm*—Venable LLP; Robert Kinberg

(57) ABSTRACT

A fiber cleaning device is provided for use with a carding machine having a rotating clothing cylinder, a housing surrounding the cylinder, and an opening in the housing for removing impurities. The device has a separating knife with a knife edge for locating in the opening and directed counter to a rotational direction of the cylinder, and a pressure regulating element installed downstream, in the rotational direction of the cylinder, of the separating knife. The pressure regulating element is for adjusting a pressure between the housing and the cylinder such that fiber material accumulation on the knife edge is promoted.

27 Claims, 4 Drawing Sheets

DEVICE ON A CARDING MACHINE FOR CLEANING AND OPENING FIBER MATERIAL

CROSS-REFERENCE TO RELATED APPLICATION

This application claims priority to German Patent Application No. 101 44 211.4 filed on Sep. 8, 2001, the disclosure of which is incorporated herein by reference.

BACKGROUND OF THE INVENTION

The invention relates to a device for use with a carding machine for cleaning and opening textile fiber material such as, for example, cotton, synthetic fibers, and the like. The device comprises a rotating clothing or wire needle cylinder surrounded by a housing. The cylinder is located downstream of a feeding device and is provided with at least one opening for removing impurities such as trash particles, leaf rests, seed husks, stem rests, sand, and the like. At least one separating knife is arranged near the clothing or the wire needles of the cylinder such that a knife edge of the separating knife is directed counter to the rotational direction of the cylinder. The knife edge is positioned at a downstream end of the opening, in the rotational direction of the cylinder.

German Patent No. 39 08 834 discloses a device of this type, in which the fiber material collects around the edge of the separating knife. A nep or burl of the fiber material is thicker than the fiber bat on the roller and is pushed onto the knife. This collection of material is known as a "fiber beard". The fiber beard remains only briefly on the edge of the knife. The neps, burls and husks often slip off of the knife edge, slip through under the knife and follow the cylinder clothing.

SUMMARY OF THE INVENTION

It is an object of the invention to create a device of the aforementioned type that avoids the aforementioned disadvantages and, in particular, permits a lasting and improved removal of the neps, burls and/or husks.

Particular embodiments of the invention provide a fiber cleaning device for use with a carding machine having a rotating clothing cylinder, a housing surrounding the cylinder, and an opening in the housing for removing impurities. The device has a separating knife with a knife edge for locating in the opening and directed counter to a rotational direction of the cylinder, and a pressure regulating element installed downstream, in the rotational direction of the cylinder, of the separating knife. The pressure regulating element is for adjusting a pressure between the housing and the cylinder such that fiber material accumulation on the knife edge is promoted.

Due to an increase in the air pressure downstream of the edge of the knife, as seen in the rotational direction of the cylinder, more neps are removed at the edge of the knife. More fibers fit themselves around the knife edge and the neps (the thickened and knotted sections) also fit themselves more clearly around the edge of the knife. A type of fiber beard or "bow wave" is created in front of or on the knife edge. It is preferable if the neps, burls, and husks are positioned on the side of the knife edge opposite the cylinder clothing. The accumulated neps, burls, and husks are thus prevented from again slipping through under the knife and following the cylinder clothing. The foreign bodies (neps, burls, and husks) accumulated and concentrated in this way can then be removed by, for example, suctioning.

Other embodiments of the invention provide a carding machine. The carding machine has a rotating clothing cylinder, a housing surrounding the cylinder, an opening in the housing for removing impurities, a fiber cleaning device, and a traveling flat having a flat bar. The flat bar has a pressure increasing element that increases a pressure upstream, in the rotational direction of cylinder, of the opening. The fiber cleaning device has a separating knife with a knife edge located in the opening and directed counter to a rotational direction of the cylinder. The fiber cleaning device also has a pressure regulating element installed downstream, in the rotational direction of the cylinder, of the separating knife. The pressure regulating element adjusts a pressure between the housing and the cylinder such that fiber material accumulation on the knife edge is promoted.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
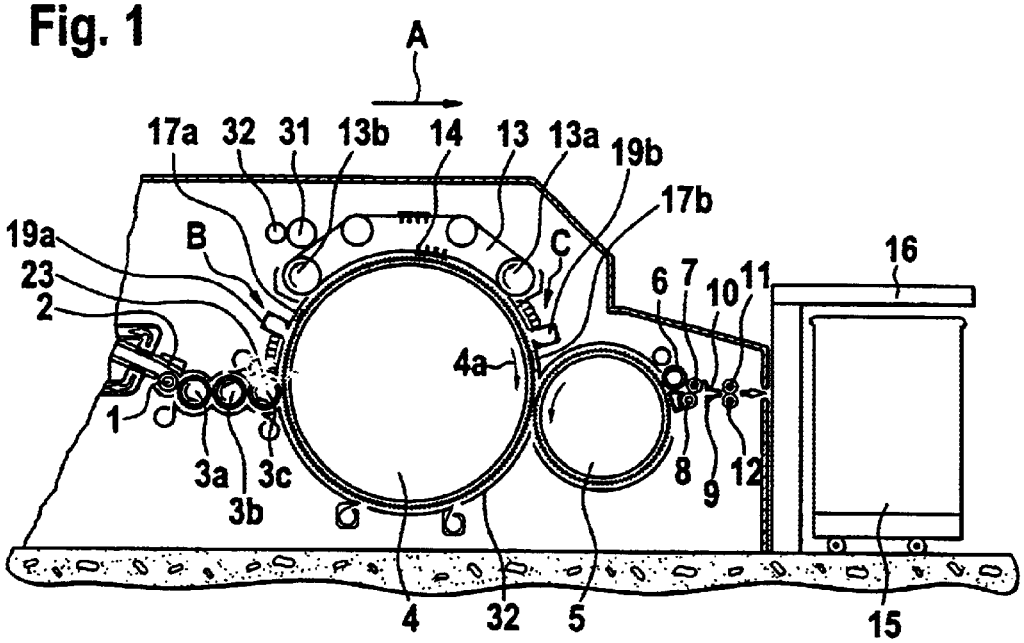
FIG. 1 is a schematic side elevation view of a carding machine including an example of the invention.
Figure 1A:
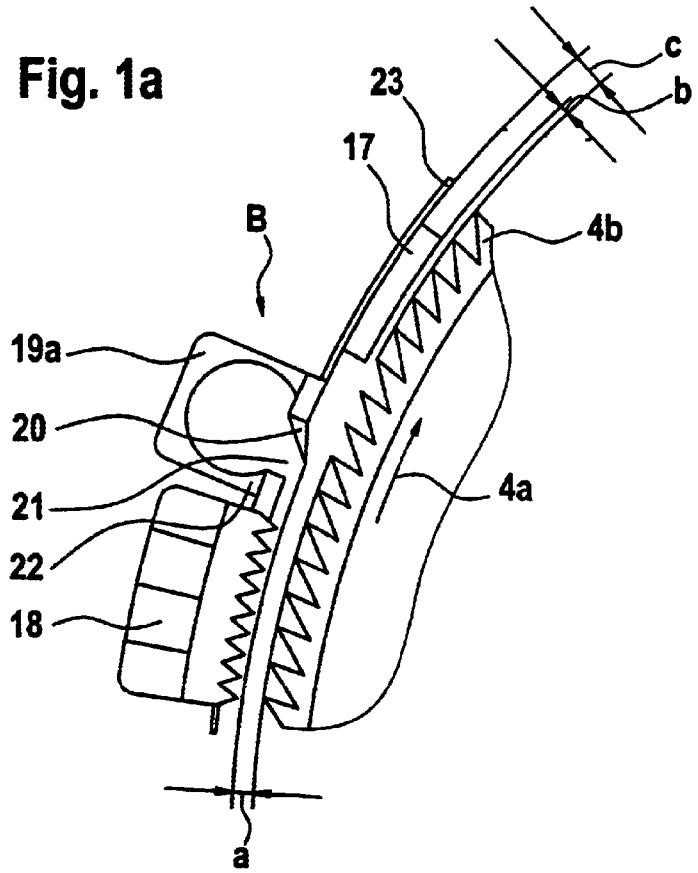
FIG. 1*a* is a partial side elevation view of an embodiment of the invention provided with a throttle bar.

FIG. 1 shows a carding machine, for example a high-performance carding machine Model DK 903 manufactured by the company Trützschler in Mönchengladbach, Germany. The carding machine is provided with feed roller 1, feed table 2, licker-ins 3*a*, 3*b*, 3*c*, main carding cylinder 4, doffer 5, stripping roller 6, crushing rollers 7, 8, sliver element 9, web trumpet 10, withdrawing rollers 11, 12, traveling flats 13 with flat bars 14, can 15 and can holder 16. Travelling flats move around rollers 13*a* and 13*b*. Cleaning rollers 31, 32 will be discussed below. Curved arrows show the rotational directions of the rollers while the operating direction is indicated by arrow A. The device 17*a*, 17*b* according to the invention can be positioned, for example, at the location B and/or C on the main carding cylinder 4. As shown in FIG. 1*a*, a stationary carding element 18, a suction hood 19*a* with a separating knife 20 and a discharge opening 21, and a pressure regulating element (in this example, a throttle bar) 17 are provided one behind the other at location B, as seen in rotational direction 4*a,* of the main carding cylinder 4. Pressure regulating element 17 can also be a carding element with clothing. A similar arrangement can be located at one or more other locations on the carding machine such as, for example, suction hood 19*b* at location C in FIG. 1. Main carding cylinder 4 has cylinder clothing 4*b*. A cover 23 is positioned opposite the cylinder clothing 4*b*. A distance a is the distance of the separating edge 20*a* (see FIG. 2) of the separating knife from the tips of the cylinder clothing 4*b*. A distance b is the distance of the pressure regulating element 17 from the tips of the cylinder clothing 4*b*. Distances a and b are preferably less than a distance c of the cover 23 from the tips of the cylinder clothing 4*b*.

Figure 2:
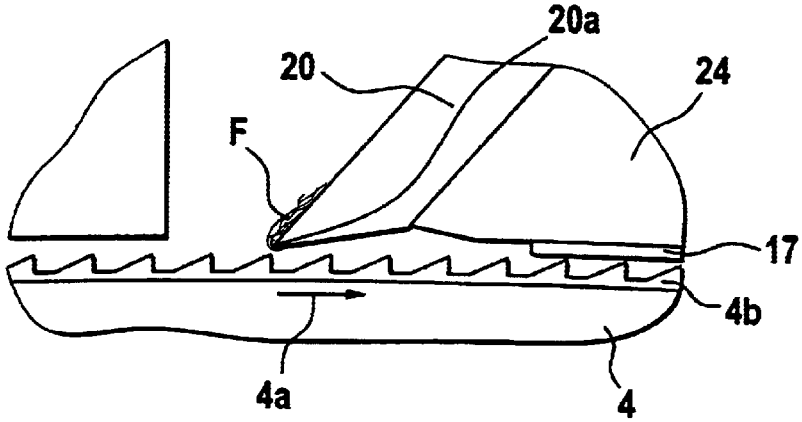
FIG. 2 is a partial side elevation view of an example of the invention showing a fiber beard with accumulated fibrous impurities such as neps.

As a result of the arrangement of the pressure regulating element 17 according to FIGS. 1*a* and 2, a pressure increase is created in the space between the housing 23 and the clothing 4*b* of cylinder 4. This pressure increase causes more (in particular, fibrous) impurities such as neps and the like to be separated from the desirable fiber material at the knife edge 20*a*.

During operation of the machine, fiber material F builds up on knife edge 20*a* (FIG. 2). A nep or burl (a thickened section or knotted section) is thicker than the desirable fiber bat and is therefore pushed more easily onto the knife 20. The increased pressure downstream of the knife edge 20*a* helps remove more neps from the desirable fiber bat at the knife edge 20*a*. More fibers will fit themselves around the knife edge 20*a* and the neps also will fit themselves more noticeably around the knife edge 20*a*. This build-up of fibers is referred to as a fiber beard F or a bow wave in front of the knife edge 20*a*. The fiber beard F remains briefly on the knife edge 20*a*. This positions the neps, burls, and husks (herein after referred to as NBH) at the correct location on the knife edge 20*a,* that is, beyond the clothing 4*b*. However, even when the NBH is in this position, it can again slip through underneath the knife 20 and follow the cylinder clothing 4*b*. This disadvantage can be corrected by the invention by processing the fiber beard F at the knife edge 20*a* to discharge the NBH. Increased pressure behind the knife 20 promotes the accumulation of the fiber beard F at the knife edge 20*a*. Mechanical or pneumatic movement of the NBH results in improved discharge of the NBH.

The invention promotes the removal of NBH by increasing the size of the fiber beard F at the knife edge 20*a* due to the increased pressure downstream of the knife 20. The increased pressure is created with the aid of a restricted location, for example a throttle bar 17 arranged at a distance of $^{14}/_{1000}$" to the main carding cylinder clothing 4*a,* downstream of the knife 20. Due to the increased pressure, the fiber beard F is long enough that it can be actively processed, for example, combed out.

Figure 3:
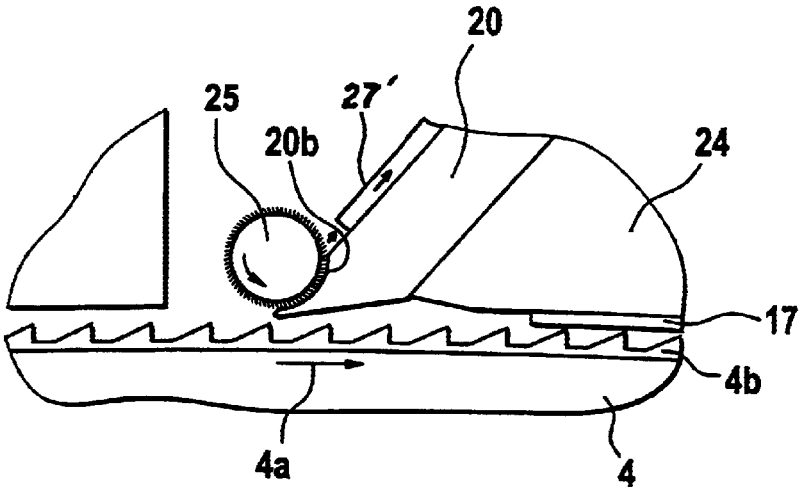
FIG. 3 is a partial side elevation view of an example of the invention having a wire-needle roller adjacent the knife edge.

In the example shown in FIG. 3, a wire-needle roller 25 (similar to clothing found on a flat bar) is rotated (in either direction) at the knife edge 20*a* and catches the NBH that accumulates on the knife edge 20*a*. The wire-needle, or other, clothing orientation depends on the rotational direction of the wire-needle roller 25. A knurled roller can also be used. The roller 25 is preferably cleaned continuously on the side facing away from the main carding cylinder clothing 4*b* by, for example, a suction tube 27'. The roller 25 is preferably set into a curved recess 20*b* above the knife edge 20*a*.

Figure 4:
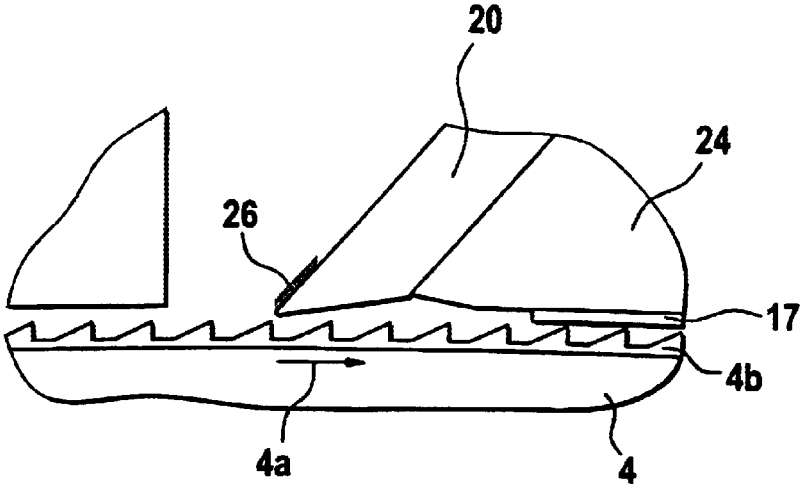
FIG. 4 is a partial side elevation view of an example of the invention having clothing on a back surface of the knife in the region of the knife edge.

In the example shown in FIG. 4, the back of the knife (beyond the clothing) is provided with a micro-clothing 26 for catching the NBH on the knife edge 20*a*.

Figure 5:
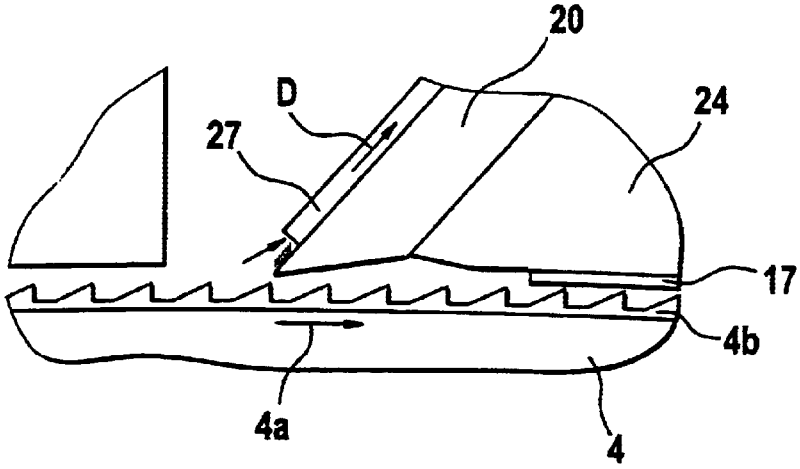
FIG. 5 is a partial side elevation view of an example of the invention having a suctioning device adjacent the knife edge.

In the example shown in FIG. 5, the NBH are suctioned, with a directed suctioning flow D, from the fiber beard F on the knife edge 20*a*. To accomplish this suctioning, the knife edge 20*a* is provided with a suctioning device 27 such as, for example, a suctioning box, a suctioning line, or the like. The suctioning can be continuous or intermittent.

Figure 6:
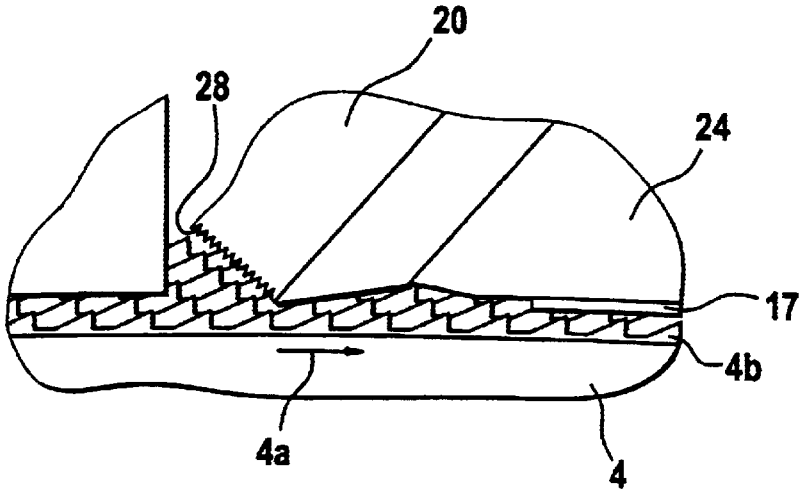
FIG. 6 is a partial side elevation view of an example of the invention having a serrated knife edge.

In the example shown in FIG. 6, the knife edge is serrated over its width so that the NBH particles are caught in the teeth 28 and the good fibers are carried along by the main carding cylinder 4. The NBH particles are preferably cyclically removed through, for example, suctioning (FIG. 5), combing out (FIG. 3), or the like.

Figure 7:
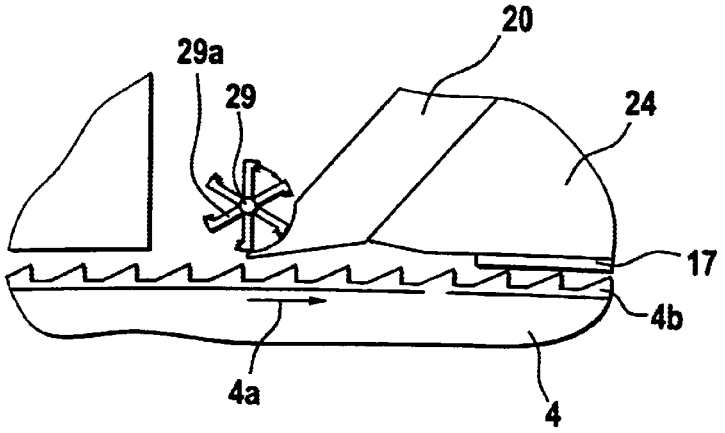
FIG. 7 is a partial side elevation view of an example of the invention having a rotating knife bar adjacent the knife edge.
Figure 7A:
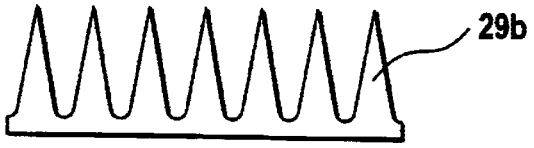
FIG. 7*a* is a partial side elevation view of the serrations of the example shown in FIG. 7.

In the example shown in FIGS. 7 and 7*a,* a roller 29 with a plurality of knife arms 29*a,* each provided with a serrated knife tip 29*b,* is arranged so that a serrated knife tip 29*b* is intermittently inserted into the fiber beard F to remove NBH particles from the knife edge 20*a*. The desirable fibers move past the serrated knife tip 29*b* back into the main carding cylinder 4. On the side opposite the cylinder clothing 4*b,* the serrated knife tips 29*b* of each knife arm 29*a* of roller 29 are cleaned.

With the exemplary embodiments shown herein, the removal of NBH particles is improved considerably through the interaction between a larger fiber beard and a special knife edge.

Figure 8:
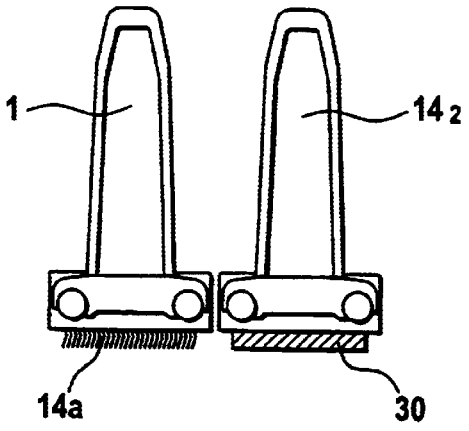
FIG. 8 is a side elevation view of a flat bar with clothing and a flat bar with a pressure beam.
Figure 9:
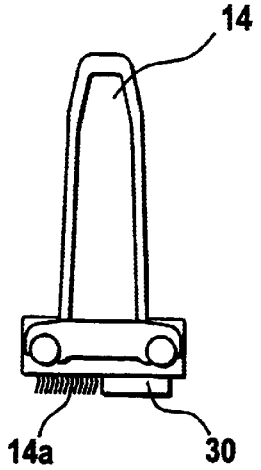
FIG. 9 is a side elevation view of a flat bar with clothing and a pressure beam.

This interaction can also be realized at other locations of the carding machine. In the example shown in FIG. 8, the clothing 14*a* of a traveling flat $\mathbf{14}_1$ can be closed off in that the following traveling flat $\mathbf{14}_2$ is provided with a closing element, e.g. a throttle bar 30. Also, as shown in FIG. 9, a throttle bar 30', or the like, on a traveling flat $\mathbf{14}_3$ can be arranged behind the clothing 14*a'*. As a result, a bow wave is created in front of the restricted location (in front of throttle bar 30, 30') and the NBH affix themselves to the clothing 14*a,* 14*a'* as a result of the mechanical impact. The NBH are then removed by rotating cleaning rollers 31, 32 (see FIG. 1) from the clothing 14*a* of the rotating flat bars 14 of traveling flats 13.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A fiber cleaning device for use with a carding machine having a rotating clothing cylinder, a housing surrounding the cylinder, and an opening in the housing for removing impurities, the device comprising:

a separating knife with a knife edge for being located in the opening and directed counter to a rotational direction of the cylinder; and a pressure regulating element installed downstream, in the rotational direction of the cylinder, of the separating knife, wherein the pressure regulating element is for adjusting a pressure between the housing and the cylinder such that fiber material accumulation on the knife edge is promoted.

2. The device according to claim 1, wherein the pressure regulating element is a throttle bar.

3. The device according to claim 2, wherein a distance between the throttle bar and the clothing cylinder is adjustable.

4. The device according to claim 2, wherein a pressure is increased in front of the throttle bar, as seen in the rotational direction of the cylinder.

5. The device according to claim 4, wherein the pressure increase is for creating an accumulation of neps, burls and husks on the knife edge.

6. The device according to claim 1, wherein the pressure regulating element is a stationary carding element with clothing.

7. The device according to claim 6, wherein a pressure is reduced behind the stationary carding element, as seen in the rotational direction of the cylinder.

8. The device according to claim 1, wherein the pressure regulating element is replaceable.

9. The device according to claim 1, further comprising a suctioning hood for positioning in the opening and around the separating knife.

10. The device according to claim 9, wherein the suctioning hood provides continuous suctioning.

11. The device according to claim 9, wherein the suctioning hood is subjected to intermittent suction.

12. The device according to claim 1, further comprising a mechanical cleaning device that cooperates with the knife edge.

13. The device according to claim 12, wherein the mechanical cleaning device is a cleaning roller.

14. The device according to claim 13, wherein the cleaning roller includes carrier elements, and the carrier elements are one of clothing, wire needles, and knurling.

15. The device according to claim 14, wherein the cleaning roller rotates in a direction that is counter to a direction in which the knife is directed.

16. The device according to claim 14, wherein the cleaning roller rotates in a direction in which the knife is directed.

17. The device according to claim 13, further comprising a suction tube directed to the cleaning roller.

18. The device according to claim 1, wherein the separating knife further comprises micro-clothing positioned on a back portion of the separating knife.

19. The device according to claim 1, further comprising a suctioning device that is directed to the knife edge.

20. The device according to claim 19, wherein the suctioning device provides continuous suctioning.

21. The device according to claim 19, wherein the suctioning device provides intermittent suctioning.

22. The device according to claim 19, wherein the suctioning device creates a targeted suction flow.

23. The device according to claim 19, wherein the suctioning device is for intermittently removing the fiber material from the knife edge through suctioning.

24. The device according to claim 1, wherein the knife edge is serrated.

25. The device according to claim 1, further comprising a serrated, rotating knife bar for intermittently combing the fiber material off of the knife edge.

26. A carding machine, comprising:

a rotating clothing cylinder;

a housing surrounding the cylinder;

an opening in the housing for removing impurities;

a fiber cleaning device having a separating knife with a knife edge located in the opening and directed counter to a rotational direction of the cylinder; and a pressure regulating element installed downstream, in the rotational direction of the cylinder, of the separating knife; and a traveling flat having a flat bar, the flat bar having a pressure increasing element that increases a pressure upstream, in the rotational direction of cylinder, of the opening, wherein the pressure regulating element adjusts a pressure between the housing and the cylinder such that fiber material accumulation on the knife edge is promoted.

27. The machine according to claim 26, wherein the flat bar further comprises flat bar clothing, and the pressure increasing element is positioned downstream, in the rotational direction of the traveling flat, of the flat bar clothing.

* * * * *